United States Patent [19]

Hurtle

[11] Patent Number: 4,568,907

[45] Date of Patent: Feb. 4, 1986

[54] LOW INDUCTANCE RESISTOR FOR HIGH CURRENT LIMITATION

[75] Inventor: Ralph L. Hurtle, W. Hartford, Conn.

[73] Assignee: General Electric Company, New York, N.Y.

[21] Appl. No.: 639,876

[22] Filed: Aug. 13, 1984

Related U.S. Application Data

[62] Division of Ser. No. 412,445, Aug. 27, 1982, Pat. No. 4,485,283.

[51] Int. Cl.[4] ..... H01C 3/02

[52] U.S. Cl. ..... 338/61; 338/62

[58] Field of Search ..... 338/61, 60, 64, 62

[56] References Cited

U.S. PATENT DOCUMENTS

| | | | |
|---|---|---|---|
| 2,639,357 | 5/1953 | Kesselring | 200/144 R X |
| 4,070,641 | 1/1978 | Khalid | 338/61 |

FOREIGN PATENT DOCUMENTS

| | | | |
|---|---|---|---|
| 269547 | 1/1914 | Fed. Rep. of Germany | 338/61 |
| 57-15401 | 1/1982 | Japan | 338/61 |

*Primary Examiner*—C. L. Albritton
*Assistant Examiner*—M. M. Lateef
*Attorney, Agent, or Firm*—Richard Menelly; Walter Bernkopf; Fred Jacob

[57] ABSTRACT

A low inductance resistor for high current limitation is arranged from a single conductor wrapped in a continuous direction to form a plurality of turns wherein current transport through each of the turns induces a corresponding magnetic field to oppose the magnetic field induced within each next adjacent turn. The resistor finds application within a current limiter unit which employs magnetic repulsion and gas pressure to direct arcs that occur between separating contacts to within the high voltage region of an arc chute. The resistor is connected across the arc to reduce the arc current to a low enough value so that the arc becomes extinguished within a predetermined period of time.

4 Claims, 6 Drawing Figures

LOW INDUCTANCE RESISTOR FOR HIGH CURRENT LIMITATION

This is a divisional of application Ser. No. 412,445, filed 8/27/82, now U.S. Pat. No. 4,485,283, issued 11/27/84.

BACKGROUND OF THE INVENTION

Circuit interruption breakers are known to form arcs during the opening of the breaker contacts. It is also known to provide a plurality of arcing PLATES to dissipate and cool the arc in a relatively rapid period of time. Means are disclosed in U.S. Pat. Nos. 2,088,489; 2,188,806 and 3,059,081, for generating a gaseous material for enhanced cooling and physically motivating the arc to within the high voltage region of the arc chute assembly.

It is also known, in certain rated breakers, to employ a magnetic field to magnetically direct the arc to within the arc chutes. U.S. Pat. Nos. 2,442,199 and 2,610,937 disclose the use of slotted plate arc extinguishers for enhancing the transfer of the arc to within the plates. U.S. Pat. No. 2,639,357 discloses the use of parallel resistance across a pair of arcing contacts to reduce the current through a current limiter as well as to assist in extinguishing the arc. Examples of circuit breakers employing vented casings can be found in U.S. Pat. Nos. 3,171,936; 3,506,799; and 4,260,863. The venting is described mainly for preventing damage to the breaker casings. U.S. Pat. Nos. 3,515,829 and 3,516,090 disclose a current limiting breaker having venting means out one end of the breaker housing, through a vented baffle.

One example of an efficient current limiting circuit breaker can be found in U.S. Pat. No. 4,375,021 entitled "Rapid Electric Arc Extinguishing Assembly For Circuit Breaking Devices Such As Electric Breakers" which is incorporated herein for purposes of reference.

U.S. Pat. No. 4,019,006 to Manfred Strossner, discloses double chamber venting wherein an arc quenching chamber is situated within an outer chamber, and the arc gases pass first through the arc quenching chamber before venting to the atmosphere via the outer chamber. This patent teaches that the back pressure and noise generated by the arc gases can be reduced by the double chamber design.

In current limiting and circuit interrupting devices rated at 400 amperes current, the factor of merit for energy dissipation is described in the terms of the $I^2t$ value which represents the product of the square of the current at interruption and the interruption time. The larger the $I^2t$ value, the lower the efficiency of the breaker for dissipating the energy created during the arc occurrence. For circuit breakers of the type currently manufactured and having a 400 ampere rating, the $I^2t$ value can be greater than $3\times10^6$; that is, in excess of 3 million.

Attempts to further decrease the $I^2t$ value at larger interrupting currents have not been entirely successful because of the large amount of noise that is generated by the expulsion of the arc gases out through the vents in the vents in the breaker housing. Noise levels of as high as 137 decibels can be created when interrupting currents of tens of thousands of amperes. This level of noise requires extensive accoustical mufflers and baffles to decrease the noise level to acceptable levels. Another device employed to reduce the noise is a parallel resistor of the type described earlier, which is fairly effective. The expense involved with the use of a resistor does not always cost-justify its use in current limiting breakers to date.

The purpose of this invention therefore, is to provide an improved current limiting device having an $I^2t$ value substantially lower than present state of the art devices with acceptable noise levels at interruption, without the requirement of resistors or baffles.

SUMMARY OF THE INVENTION

A current limiting unit employs an arc chute containing a plurality of arc plates within a casing of carbonaceous material. The carbonaceous material having a carbon-to-oxygen ratio of 1 to 1 provides a source of hydrogen molecules for cooling and deionizing the arc plasma during contact opening without leaving a residual carbon coating on the surface of the casing. The carbonaceous material also provides an ablative surface to the arc for generating the hydrogen atoms. The carbon and oxygen rapidly combine with free oxygen to form carbon dioxide gas which is harmless to the environment. A magnetic field is generated by the arrangement of a plurality of steel laminations around the contact support arms and forces the ionized gases along with carbon dioxide and hydrogen to enter the arc chute. The casing is gas tight except for vents coextensive with and transverse to the plates forming the arc chute. The ionized gas as well as the generated gases are rapidly forced into the arc chute under pressure. To assist in rapidly extinguishing the arc, a low inductance impedance can be electrically connected in parallel with the arc contacts.

GENERAL DESCRIPTION OF THE INVENTION

Figure 1:
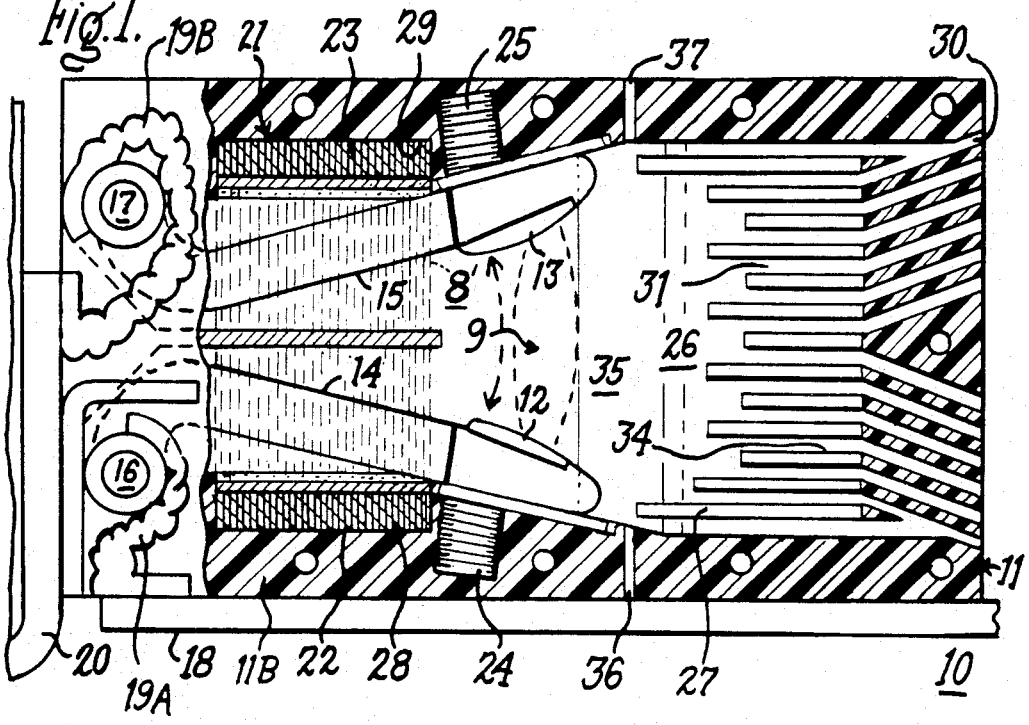
FIG. 1 is a plan view in partial section of the bottom of the current limiter of the instant invention.

As described earlier, one of the important factors to be determined in evaluating the effectiveness of a current limiting device is the $I^2t$ value wherein the current value through the current limiting device is multiplied by the time that the current exists within the device during switching.

The larger the $I^2t$ value, the less efficient the current limiting device for reducing the current through the series circuit. The mechanism of current reduction in a current limiting device depends upon the resistance of the arc formed when the contacts are caused to open during a fault condition. The effective use of a plurality of grids or plates within an arc chute for cooling and deionizing the arc greatly increases the arc resistance. When the arc resistance exceeds a predetermined level, the arc is unable to sustain itself and becomes extinguished.

Current state of the art devices employing the mechanism of magnetic blowout whereby an intense magnetic field forces the charged gaseous material within the arc into a specially designed arc chamber having slotted arc grids, do not move the arc far enough within the arc chute to substantially reduce the $I^2t$ value to less than a few million $I^2t$ units in a sufficiently short period of time.

One of the reasons for failure to penetrate the arc chute assembly is the back pressure which results due to the resistance to gas flow presented by the grids in the gas flow path. The large number of grids required within the close spacing of the arc chute assembly is found to produce a back pressure upon the arc gases to actually limit the flow of gases through the spaced grids. Venting the casing transverse to the grid alignment direction is found to substantially reduce the back pressure exerted by the gases without altering the direction of gas flow. This side or lateral venting therefore, is an important feature of the instant invention, not only for reducing back pressure but also for reducing the amount of noise created by the expulsion of gases out of the casing.

The instant invention, by employing an ablative surface in the vicinity of the arcing contacts, creates a high-pressure hydrogen-rich gas which is confined in all directions except for the directions of the arc chute. The hydrogen gas is immediately expelled through the grids within the arc chute and out the sides of the vented casing next to the arc chute grids as well as out the end of the grids themselves since the back pressure effects are substantially reduced by the dual gas vent design. The hydrogen gas, being of small molecular MASS, rapidly moves heat as well as charged particles from the arc to deionize and to cool the arc plasma, thereby increasing the arc resistance. In order to further promote the extinguishing of the arc and hence reduce the time that the large fault currents flow through the current limiting device, a low inductance resistor can be employed to transform the electrical energy within the arc to thermal energy within the resistor.

It is believed that efficient current limiting can be achieved by rapidly opening the unit contacts to form an arc and increasing the arc resistance to the highest possible value to extinguish the arc in the shortest period of time. The particular dual arrangement of the casing vents in combination with the unique resistor configuration result in the lowest $I^2t$ current limiter unit heretofore attained.

DESCRIPTION OF THE PREFERRED EMBODIMENT

Figure 3:
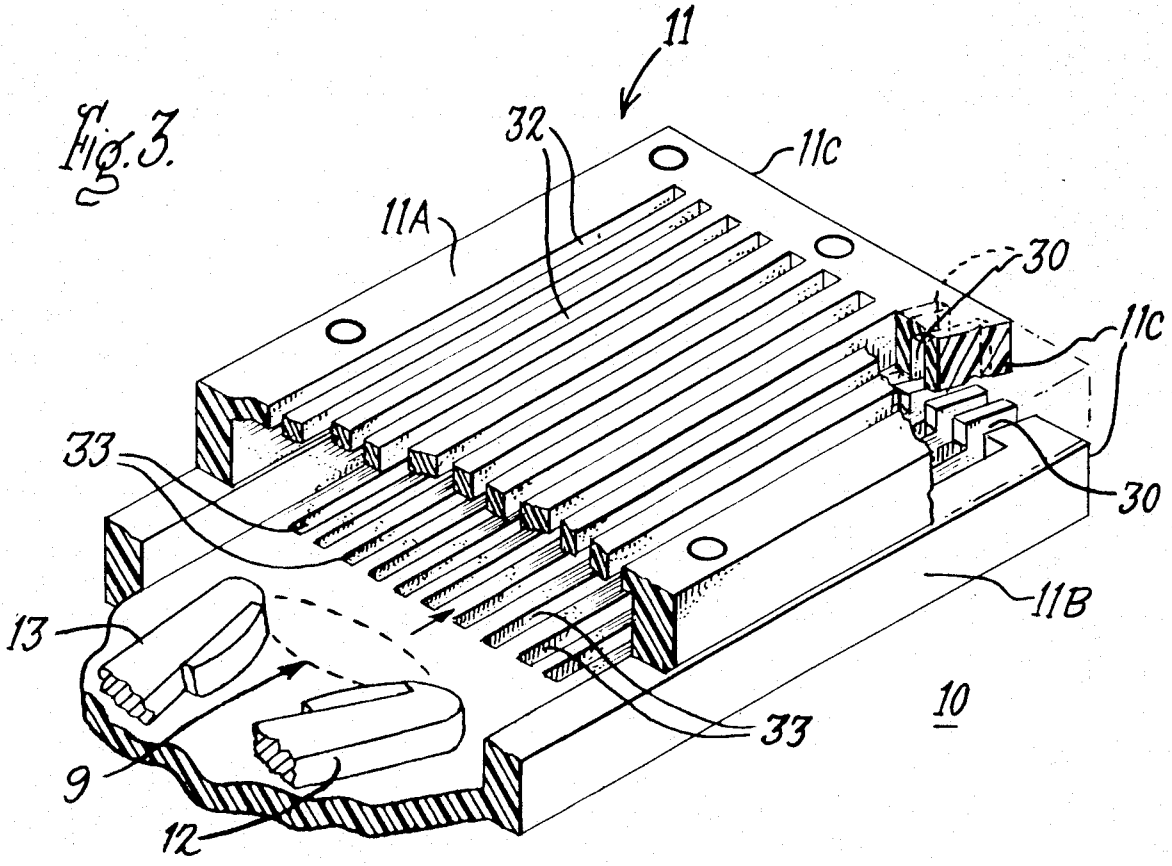
FIG. 3 is a top perspective view of a cutaway portion of the current limiter casing with the arc plates removed to show lateral venting throught the cover and bottom of the casing.

FIG. 1 shows a current limiter 10 made from an insulated casing 11 of a carbonaceous material such as polyoxymethylene, which is an acetal resin having the general formula $H_2CO$. Within casing 11 is a pair of arcing contacts 12, 13 connected by means of contact arms 14 and 15 which are electrically connected to a pair of terminals 16, 17. Terminal 16 is connected with the load strap 18 by means of a braided conductor 19A, and terminal 17 is connected with line strap 20 by means of braided conductor 19B. The magnetic motor described generally as 21, includes a plurality of magnet steel side laminations 22, 23 arranged on both sides of contact arms 14, 15 to strongly enhance the magnetic force acting upon these contact arms to repel them from each other and thereby rapidly separate electrical contacts 12 and 13 during high current interruption. The use of magnetic material to effect monitoring of contact arms is known as described in U.S. Pat. No. 1,763,502 to Branchu, which patent is incorporated herein for purposes of reference. A pair of force springs 24, 25 are used to move contacts 12, 13 into electrical connection in the absence of any magnetic forces appearing on contact arms 14, 15. In order to deionize and cool arc 9 occurring between contacts 12, 13 upon becoming separated, an arc chute 26 consisting of a plurality of grids or plates 27 spaced parallel from each other and formed from a conductive material, such as brass, steel or copper, is positioned immediately forward of the contacts. Casing 11 is formed of a pair of two halves consisting of cover 11A and base 11B (FIG. 3) each half 11A, 11B containing a pair of parallel slots 28 and 29 for retaining side laminations 22 and 23. Casing 11 is gas tight and a thin gasket or gas impervious coating (not shown) may be employed between both halves of the casing to prevent the expulsion of gas in any but a preferred direction. In order to allow for the exit of gases generated by the ablation of casing 11 during arcing, a plurality of end vents 30 are provided at the exit end of casing 11 coextensive with the corridors 31 which exit between the individual grids 27. The acetal resin forming the basic composition of casing 11 becomes rapidly heated in the vicinity of contacts 12, 13 where the arc is first formed and ablates to give off the compositional gases, namely hydrogen, CARBON, and oxygen. The hydrogen molecules, because of their small size, and the high temperature existing in the vicinity of the arcing contacts, become thermally active and rapidly move into arc chute 26, being the path of least resistance to the pressure-confining casing 11. The hydrogen molecules pass through the arc 9 formed between contacts 12, 13 and remove heat from the arc as well as charged particles, causing the electrical resistance of the arc to increase at a rapid rate. The acetal resin being a carbonaceous material continuously exposes carbon atoms at the ablative surface which immediately combine with the oxygen atoms within casing 11, as well as residual oxygen from the atmosphere, to from carbon dioxide gas. The carbon dioxide gas also becomes forced through the arc and out through corridors 31 and end vents 30 out from casing 11. In the process of the rapid transfer of hydrogen and carbon dioxide gas molecules, the arc becomes rapidly forced into contact with grids 27 whereby they lose thermal energy by the mechanism of thermal conduction as well as electrical energy by the recombination of the electrons within the arc with the atoms existing on the surface of grids 27. In order to further promote the transfer of hydrogen and carbon dioxide gas out from the casing 11, a plurality of slotted vents 32, 33 are provided on cover 11A and base 11B of casing 11. This lateral or side venting reduces back pressure which would otherwise occur and resist the movement of the arc to within the arc grids as well as reducing noise as will be discussed below in reference to FIG. 3. It can be seen, therefore, that casing 11 being gas tight in all directions except for end vents 30 and lateral vents 32, 33, causes any gases ablated from casing 11 to become immediately and directly forced out through vents 30, 32, 33 bringing the arc occurring between contacts 12 and 13 out to the furthest edges 34 of grid 27. This is an important feature of this invention since hydrogen and carbon dioxide gases are evolved for the purpose of cooling the arc plasma and for forcing the arc instantaneously through arc chute 26. The $I^2t$ value is reduced by the rapid transport of the arc out into arc chute 26 by reducing both the time that the arc exists as well as the arc current.

Figure 2:
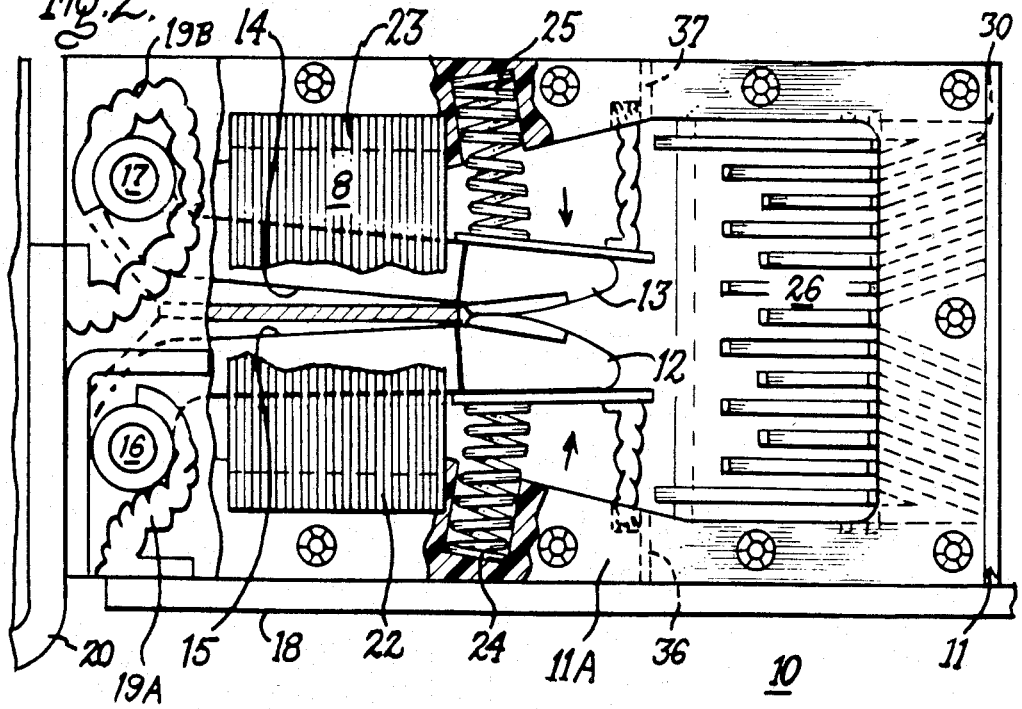
FIG. 2 is a plan view through the casing cover of the current limiter depicted in FIG. 1 with its contacts in a closed configuration.

FIG. 2 shows the current limiter 10 of the invention with contacts 12, 13 shown in a closed position with force springs 24, 25 fully extended and only a nominal magnetic flux existing in laminations 22, 23 which are shown to include a top portion 8 supported within the top of casing 11, described earlier, but not shown. Top laminations 8 form a closed magnetic path encompassing contact arms 14, 15. A plurality of bottom magnetic laminations 8, shown in dotted lines in FIG. 1, arranged within casing 10, complete the closed magnetic path existing between side laminations 22, 23 and between top laminations 8. It is to be noted that the resulting magnetic force which acts upon contact arms 14 and 15 in the plane defined by the motion of contacts 12 and 13 also assists in further motivating the arc out to within arc chute 26 in combination with the ablated gases, end vents 30 and lateral vents 32, 33 described earlier. The closed magnetic path defined above is concentrated on the contact arms 14, 15 and only fringes upon the contacts 12, 13. This is to control the resulting magnetic field strength at the contacts in order not to motivate the arc to such an extent that arc-restriking would occur at the contacts themselves. This exclusion of the magnetic laminations from the contacts themselves is an important feature of this invention.

The generation of the arc also produces a large amount of noise by the expulsion of the arc gases from the circuit breaker casing. The configuration of the circuit breaker casing 11 depicted in FIG. 3 wherein the cover 11A and base 11B are provided with lateral vents 32, 33 coextensive with the arc chute corridors 31 of FIG. 1, results in an efficient noise muffler or baffle for the arc noise. Decibel readings for the same breaker having a casing which contained only end vents 30, such as shown in dashed lines, along the back 11C of casing 11 measured as high as 137 upon arc formation. The addition of lateral vents 32, 33 were found to reduce the arc noise down to 123 decibels, which is well within acceptable noise standards. It was discovered that the provision of lateral vents 32, 33 in combination with end vents 30 multifunctionally resulted in an arc chute 26 which also served as an integrally formed baffle chamber by releasing the high pressure gases with diminished sound without detering the motivation of the arc in the arrow-indicated direction. The arc rapidly proceeded under the arc gas pressure out through end vents 30, with negligible back pressure and substantially reduced noise. The lateral vents 32, 33 formed in the cover 11A and base 11B of equal number in order to distribute the thermal strain produced on casing 11 during the arc occurrence. In some designs, the lateral venting can be provided by a larger number of lateral vents 32, 33 on either the cover or the base than shown in the embodiment depicted in FIG. 3.

Figure 4:
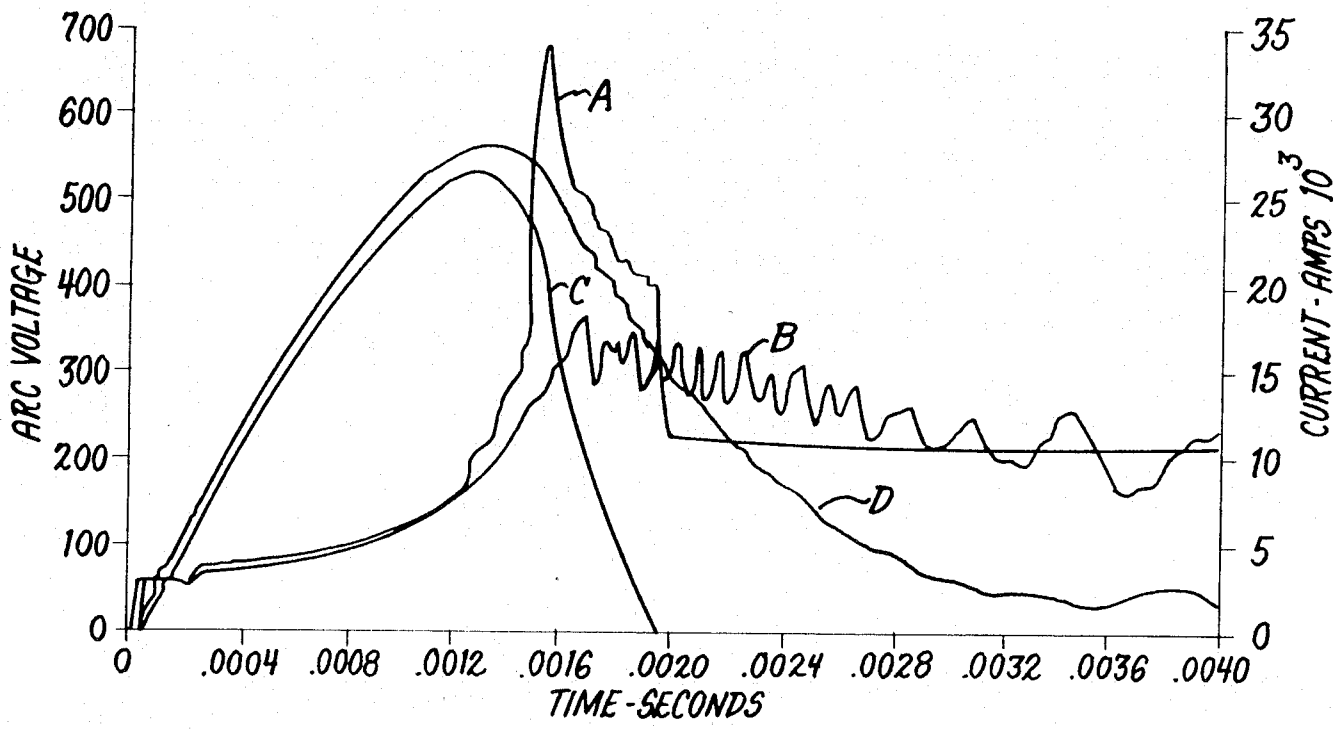
FIG. 4 is a graphic representation of the relationship between the arc voltage and time for the current limiter of the instant invention compared to a state of the art current limiter device.

To show the enhanced effect of the combination of magnetic force and compressed gas force upon the arc 9 existing between contacts 12 and 13 when in the open position depicted in FIG. 1, measurements were made on two circuit breaker units having the arc voltage values A and B depicted in FIG. 4. A represents the arc voltage for the current limiter device 10 of the invention employing both magnetic and high-pressure arc blowout, whereas B represents the arc voltage for a device employing solely magnetic arc blowout means. Also depicted in FIG. 4 is the current C for the current limiter 10 of the invention and the current D which represents the current through a current limiter employing magnetic blowout alone. It is apparent from a comparison between the arc voltage A of the current limiter 10 with the arc voltage B of the current limiter employing solely magnetic blowout, that the voltage rises faster and decreases to a steady controlled value with the current limiter 10 of the invention. It can also be seen that the current C through voltage limiter 10 drops substantially faster than the current D of the current limiter solely employing magnetic blowout.

Figure 5:
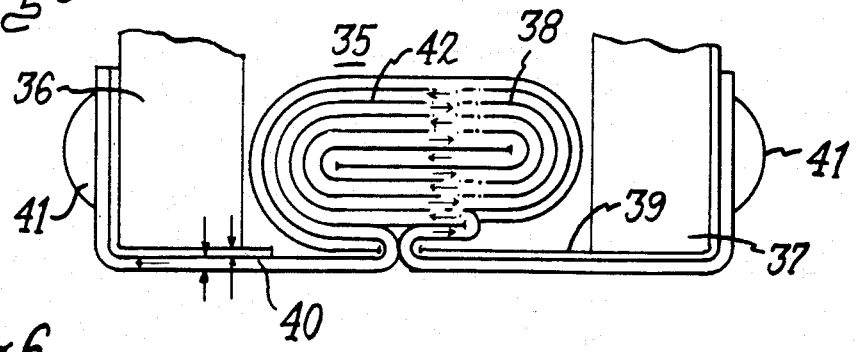
FIG. 5 is a top view of the low inductance resistor of the invention.

In order to further reduce the current through current limiter 10 upon the occurrence of excess current, such as occurs during fault conditions, a low inductance resistor 35, shown in FIG. 5, can be electrically connected in parallel with contacts 12, 13 (FIGS. 1, 2) by means of conductor 36 attached to load strap 18 and by conductor 37 attached to contact arm 14. The provision of resistor 35 further reduced the $I^2t$ value and the arc noise exiting from the casing by providing a parallel current path for the overload current through current limiter 10. Resistor 35 is selected to have a positive volt-ampere characteristic, in order to exhibit a low resistance value prior to the transfer of overload current. After receiving overload current, the resistor 35 rapidly increases in both temperature and resistance. The rapid expulsion of the arc to within arc chute 26, as described earlier, rapidly increases the electrical resistance of the arc to a point where the parallel overload current flowing through resistor 35 is greater than the arc current, that is, the current flowing between the open contacts 12, 13 shown in FIG. 1. When this condition occurs, the current between contacts 12, 13 decreases to a level such that the arc can no longer be sustained and hence becomes extinguished. All the overload current then transmits through resistor 35 and the arc energy becomes completely transposed into heat energy causing the tempeature of resistor 35 to reach a high steady state value. When this overload current passes fully through resistor 35, however, substantial magnetic forces are generated which act upon the current through the resistor thereby increasing the current density through the resistor along a narrow path.

In order to prevent the strong magnetic forces from causing the current passing through resistor 35 to localize at a particular path and increase the current density to such a value that would cause the resistor material to melt, the configuration depicted in FIG. 5 is employed. Resistor 35 comprises a plurality of turns 38 of iron foil having a thickness of approximately five thousandths of an inch. Other high-melting-point materials such as molybdenum and tungsten can also be employed. The turns are arranged from a single conductor folded at a point intermediate the ends of the conductor and wrapped in a continuous direction about a mid-point to form the turns wherein current transport through each of the turns induces a corresponding magnetic field to oppose the magnetic field induced within each next adjacent turn. The ends of the conductors are each provided with a partial turn to reverse the direction of the conductor ends from each other. By arranging turns 38 in the manner shown, current flow through each individual turn is in an opposite direction as indicated by arrows and hence their accompanying magnetic fields oppose and cancel. The provision of turns 38 having opposing magnetic fields is important since a large magnetic field on any individual turn 38 could cause the current to move into a narrow path having a current density in excess of the current carrying capacity of the resistor material as described earlier. The terminal ends 39, 40 of resistor 35 are fabricated from a double thickness metal foil having measured thickness approximately equal to ten thousandths of an inch. Connected between terminal 39 and conductor 37 can be made by means of a screw or rivet 41, and electrical connection between terminal end 40 and conductor 36 can be made by means of a similar screw or rivet 41. The provision of a larger thickness to terminal ends 39, 40 is required because the magnetic flux acting upon the current transporting through these ends is sufficient to cause an increase in the current density, since the corresponding magnetic forces are not cancelled exterior to the resistor turns 38. In order to promote the close spacing between turns 38, an interceding layer of a resistance material 42, such as high-temperature paper or plastic insulation, is employed. Alternatively, turns 38 can be coated with a high-temperature insulating material such as a polyamide. The close proximity of the individual turns 38 reduces the electrical inductance which occurs within a plurality of turns of an electrical conductor. The low inductance is a valuable feature of a current limiter since inductance prolongs the time required to switch the current from the contacts to the parallel resistor.

Figure 6:
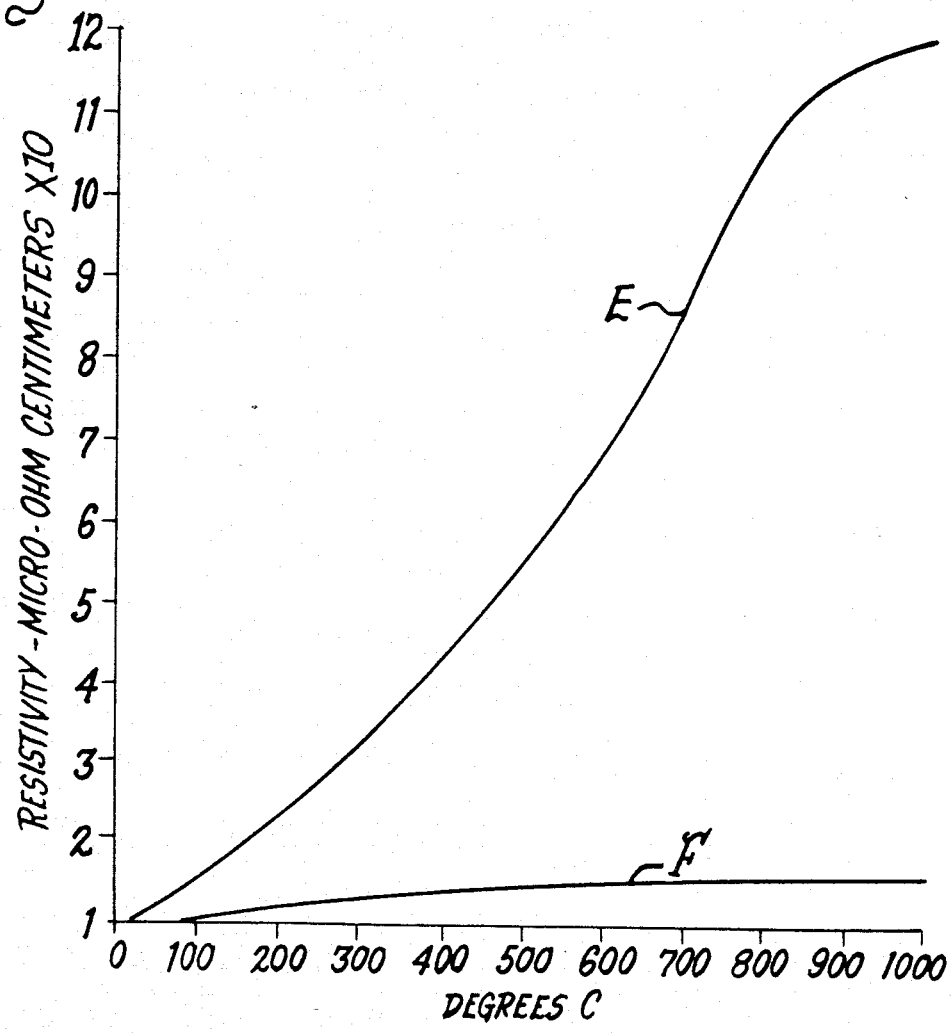
FIG. 6 is a graphic representation of the relationship between resistance and temperature for the iron material used to form the low inductance resistor of the invention.

FIG. 6 depicts the positive volt-ampere characteristic E of pure iron in terms of micro-ohm centimeter resistivity as a function of the temperature to which the iron becomes submitted. In order to sufficiently transform arc energy, which is electrical, to thermal energy within a resistor, the resistance must rapidly increase with increasing temperature. Since several hundred degrees centigrade are employed to reach reasonable resistance values, the resistor must have a melting point far in excess of the temperature employed during overload conditions. For the pure iron used to obtain the volt-ampere characteristic E shown in FIG. 5, the melting point is calculated to be 1500° C., and the requisite operational temperature range under overload conditions is from 700° to 900° C. with a resisting range of 90–120 micro-ohm centimeters.

The combination of magnetic and controlled gas pressure blowout along with a parallel low inductance resistance results in a low $I^2t$ value of 592,000 compared to 915,000 for a state of the art current interruptor device solely employing magnetic blowout means for a given circuit.

What I claim as new and desire to secure by Letters Patent is:

1. A low inductance resistor for high current limitation comprising:

a plurality of turns of a metal conductor having a resistivity of 90 to 120 micro-ohm centimeters resistance within a temperature range of 700° to 1000° C., and having a first thickness for the transport of current within said terms; and a second thickness greater than said first thickness comprising end terminals for said turns, said turns being arranged from a single conductor folded at a midpoint intermediate the ends of said conductor and wrapped in a continuous direction about said midpoint to form said turns wherein current transport through each of said turns induces a corresponding magnetic field to oppose the magnetic field induced within each next adjacent turn;

whereby said end terminals comprise a pair of ends of said conductor, one of said ends having a partial turn to reverse the direction of said one terminal end opposite from said other terminal end.

2. The resistor of claim 1 wherein the ratio of said second thickness to said first thickness is two to one.

3. The resistor of claim 1 wherein said metal is selected from the group consisting of iron, tungsten and molybdenum.

4. The resistor of claim 1 further including an electrically insulating coating on said turns to prevent electrical transport directly between said turns.

* * * * *